United States Patent [19]

Muller et al.

[11] 4,126,176

[45] Nov. 21, 1978

[54] FOUNDRY MOLDING MACHINE FOR BOX MOLDS

[75] Inventors: Günter Müller, Karlsruhe; Gerhard Blankenhorn, Friedrichstal, both of Fed. Rep. of Germany

[73] Assignee: Badische Maschinenfabrik GmbH, Fed. Rep. of Germany

[21] Appl. No.: 762,519

[22] Filed: Jan. 26, 1977

[30] Foreign Application Priority Data

Feb. 3, 1976 [DE] Fed. Rep. of Germany ... 7602966[U]

[51] Int. Cl.[2] ..... B22C 11/00; B22C 15/22

[52] U.S. Cl. ..... 164/160; 164/201

[58] Field of Search ..... 164/20, 22, 195, 160, 164/200, 201, 202

[56] References Cited

U.S. PATENT DOCUMENTS

| | | | |
|---|---|---|---|
| 587,031 | 7/1897 | Adams | 164/22 |
| 2,112,910 | 4/1938 | Jeffrey | 164/22 |
| 2,798,266 | 7/1957 | Herbruggen | 164/22 |
| 2,866,242 | 12/1958 | Miller | 164/22 |
| 2,876,508 | 3/1959 | Amala et al. | 164/22 X |
| 2,877,522 | 3/1959 | Herbruggen | 164/195 |
| 3,089,207 | 5/1963 | Miller | 164/22 |
| 3,212,141 | 10/1965 | Hansberg | 164/195 |
| 3,589,431 | 6/1971 | Fellows | 164/22 X |
| 3,807,483 | 4/1974 | Buhler | 164/195 X |

*Primary Examiner*—Richard B. Lazarus

*Attorney, Agent, or Firm*—Craig & Antonelli

[57] ABSTRACT

The molding machine has injection apparatus which operates with compressed air for filling a molding box with molding sand and pre-compacting the sand. Vents for escape of spent air from the molding box are provided in a filling frame, which rests on the molding box during filling and compaction, and may also be provided on the surface of a pattern plate carrier and in a pressure plate against which the sand is finally consolidated by pressure exerted through said carrier. Exhaust means for the spent air comprise an annular passage on the outside of the filling frame. The pressure plate is formed to define nozzles through which the sand is injected into the molding box. Means are described for supplying sand and compressed air, for conveying a succession of molding boxes and for mounting, lifting and lowering the pattern plate carrier and withdrawing the latter for replacement of the pattern.

7 Claims, 2 Drawing Figures

FOUNDRY MOLDING MACHINE FOR BOX MOLDS

The invention relates to foundry molding machines, particularly continuous machines, for producing box molds and comprising apparatus for filling the molding box with molding sand, a pressure plate and, acting against this latter, press apparatus for compacting the molding sand and having a pattern plate carrier, and a filling frame which rests on the molding box during filling and compaction.

In the case of the known molding machines of this type, the molding boxes follow a horizontal path through the machine. In the machine, firstly the pattern plate carrier with the pattern clamped upon it moves up to the molding box from below, lifts it off the conveyor and carries it up to a filling frame disposed above the molding box. The molding box is then filled with sand from a filling vessel disposed in the head of the machine, the filling frame holding the excess sand needed for consolidation. At the same time or subsequently thereto, the molding sand filled into the box is pre-compacted by a jolter or vibrator, so that it is flowlessly packed around the contours of the pattern. Then the press apparatus comes into operation, pressing the molding box, or rather its sand filling against the pressure plate until the desired degree of final compaction or consolidation is achieved. Once the press apparatus with the pattern plate carrier and the molding box has moved away and reached the level of the conveyor, the molding box can be moved laterally out of the machine. It is then possible to make up the next molding box.

Pre-compaction of molding sand by the jolting or vibration process involves a considerable noise nuisance and it is therefore undesirable for industrial medical reasons. Furthermore, the jolting movements subject the machine to dynamic stresses so that it must be correspondingly robust in construction.

The invention arises out of the problem, in the case of a molding machine of the type described at the outset, of suggesting a method of pre-compaction which is more satisfactory from an industrial medical point of view.

According to the invention, this problem is resolved in that the apparatus for filling and pre-compacting the molding sand is a blasting or injection apparatus operating with compressed air and in that the filling frame has apertures through which spent air can escape from the molding box.

Molding-sand injection apparatus are already known in the form of core-injection machines. They have also been used for boxless molds in which case the molding frame needed for final compaction has the apertures needed for venting purposes. The injection apparatus has the advantage that the noise nuisance is less and above all is only short-lived. The pressure needed for compaction is generated in that compressed air from a receiver is applied to the surface of the molding sand suddenly or percussively, so that the molding sand shoots into the mold at high velocity.

Such known blasting apparatus cannot be immediately used on molding machines of the type mentioned at the outset, since the very expensive molding boxes cannot be provided with the apertures needed for venting purposed. This is made possible by the invention in that the venting apertures are provided in the filling frame. When the molding sand is shot into the molding box, the sand is thrown against the pattern. The compressed air seeks out the line of least resistance which generally is along the walls of the molding box, so that the compressed air flows up the walls of the molding box and into the filling frame where it can escape through the venting apertures.

Instead of the venting apertures in the filling frame or in addition to such apertures, the pattern plate carrier may also have venting slits on its surface. In this case, the compressed air from the pattern can also escape downwards, i.e. almost in the direction of shooting.

Preferably, the filling frame has on the outside an annular passage into which the venting apertures discharge. This avoids the compressed air flowing out into the surroundings; instead, it is collected in the annular passage and can then be carried away via an exhaust duct connected thereto. Thus, any sand which may escape through the venting apertures, which will generally be provided as narrow slit-form nozzles, cannot spray out into the surroundings.

In order to facilitate and even accelerate the escape of compressed air, it is possible, according to a further feature of the invention, for the venting apertures of the annular passage to be connected to a vacuum pump, so increasing the pressure gradient available for venting purposes.

Molding machines are known in which the pressure plate either remains constantly in the axis of the machine or is also driven out laterally. According to a feature of the invention, a pressure plate of the first-mentioned kind is preferably used and is formed as a nozzle plate to allow the molding sand to pass through it. The pressure plate can therefore remain in the pressing axis of the machine during all stages of the work. The sand is shot through the pressure plate into the molding box. In this case, the nozzle apertures in the pressure plate preferably widen out conically away from the molding box. With such a pressure plate, a further positive effect is achieved during compaction: if, during final compaction, the molding box is pressed against the pressure plate by means of the press apparatus, then the molding sand can recede or yield where nozzle apertures are present, with the result that the pressure applied is adapted to the shape of the pattern. This effect is therefore similar to that in the case of the known molding machines, in which, instead of the pressure plate, multiple rams or tampers are provided which act only on certain zones of the box filling.

An embodiment of the invention is described hereinafter, by way of example, with reference to the accompanying drawings, in which.

Figure 1:
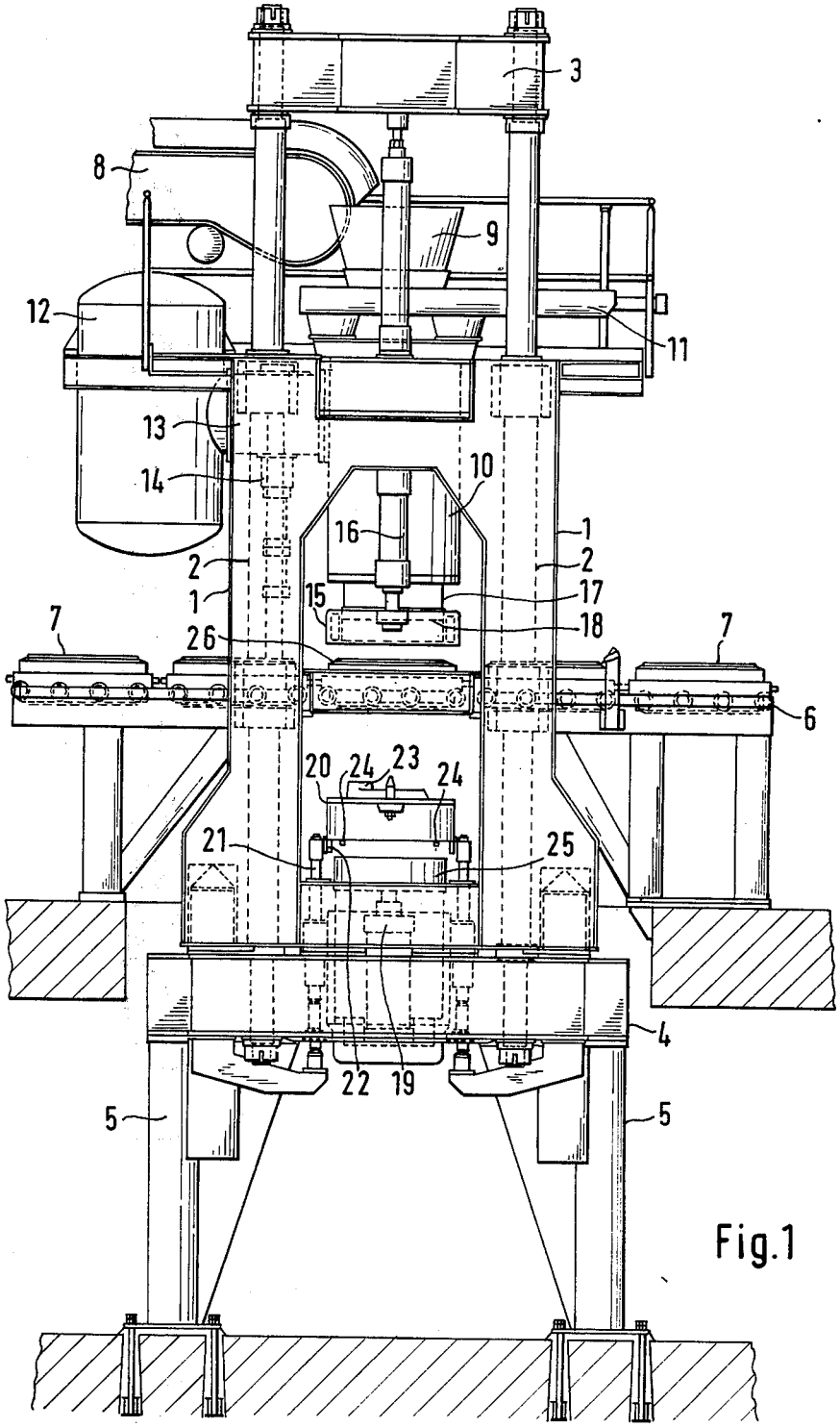
FIG. 1 is a side view of a machine embodying the invention.

The molding machine shown in FIG. 1 has a frame with two uprights 1 and columns 2 disposed therein. The columns 2 are braced at their top end by a cross-head 3 and are carried at their bottom end by a frame 4 which is secured to the foundation via feet 5. Extending through, between the uprights 1, is a conveyor which takes the form of a roller conveyor 6, by means of which the molding boxes 7 can be conveyed through the machine. In the upper part of the machine, below the cross-head 3, is the discharge end of a conveyor means 8 for bringing up supplies of molding sand which are discharged into a hopper 9 whence it can be transferred to a filling vessel 10. The hopper and its overflow to the vessel 10 can be moved out of the machine by means of a hydraulic ram 11. Furthermore, a closure plate is provided for the filling vessel 10, though it is not shown in the drawing. Disposed laterally of the machine is a compressed air receiver 12 which communicates with the filling vessel 10 through a duct 13. The duct 13 is shut off by a valve 14 which may be, for example, hydraulically operated.

Disposed in the vertical axis of the molding machine is a filling frame 15 which can be lifted in the axis of the machine by two hydraulic rams 16. Furthermore, a ram 17 with a pressure plate 18 is disposed in the axis of the machine.

Below the conveyor 6 and likewise in the axis of the machine there is a press apparatus 19. Above the press apparatus is a pattern plate carrier 20 which is mounted on guide columns 21 through rollers 22. A pattern 23 is mounted on the pattern plate carrier 20, while the pattern plate carrier 20 has on its underside centering studs 24 for a presser table 25 of the press apparatus 19.

The machine operates in the following way:

Firstly, the pattern plate carrier 20 with the pattern 23 moves up to the underside of the molding box 26, which is situated in the machine, and lifts the box off the roller conveyor 6 until its top comes to bear against the underside of the filling frame 15. Previously or simultaneously the filling vessel 10 is filled with molding sand and the filling aperture closed. Thereupon, the valve 14 is opened so that the compressed air is released into the filling vessel and shoots the sand into the molding box. In consequence, the sand in the molding box is pre-compacted. Final compaction or consolidation occurs by means of the press apparatus 19 which, through the pattern plate carrier and the molding box, presses the sand filling contained therein against the pressure plate 18 and consolidates it. The consolidated molding box leaves the molding machine, for example in a leftwards direction. In the event of a different pattern having to be molded, the pattern plate carrier with the pattern 23 is moved laterally out of the machine by means of the rollers 22 and is returned with the desired new pattern mounted on it.

Figure 2:
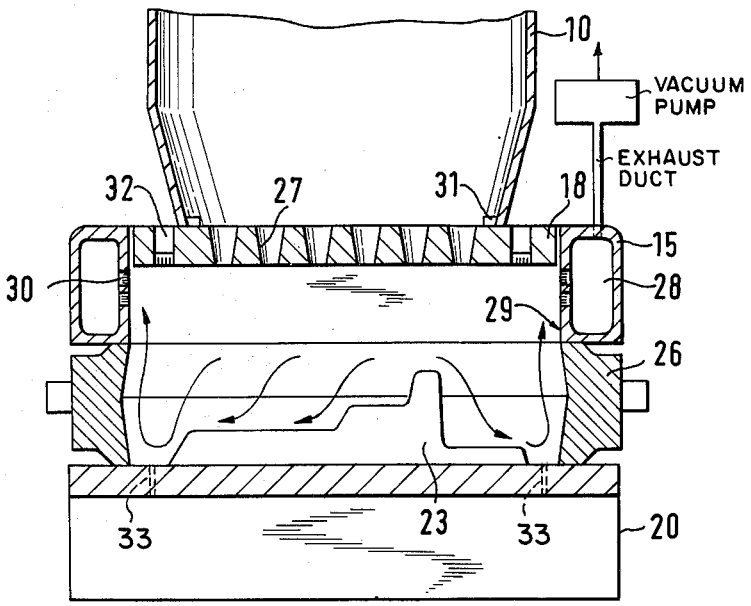
FIG. 2 shows an enlarged section through a molding box and a filling frame.

FIG. 2 diagrammatically shows the structural parts of the molding machine which effect the consolidation. In the case of this embodiment, the pressure plate 18 has a plurality of nozzles 27 which narrow conically from the filling vessel 10 to the molding box 26. The pressure plate is located directly below the aperture 31 of the filling vessel 10. The filling frame 15 has an external annular passage 28 which communicates with the interior of the filling frame and the molding box 26 through a plurality of slitform nozzle apertures 30 located on the inner wall 29 of the filling frame. The annular passage 28 may be connected to an exhaust duct, shown schematically in FIG. 2. In the case of the embodiment shown, the pressure plate 18 also has venting apertures 32 in the area immediately outside of the aperture 31 of the filling vessel 10.

The molding sand is shot through the nozzles 27 into the filling frame and the molding box 26, the compressed air flowing more or less in the direction indicated by the arrows, i.e. flowing upwards along the inner walls of the molding box 26 and escaping into the annular passage 28 through the venting apertures 30. Furthermore, the compressed air can also escape through the venting apertures 32 in the pressure plate. Venting slits 33 may also be provided on the surface of the pattern plate carrier 20. The exhaust duct and the venting apertures may be connected to a vacuum pump, as hereinbefore mentioned.

The volume which has to be injected via the nozzles 27 is so calculated that the cavity existing between the pressure plate 18 and the pattern 23 or pattern plate carrier 20 is completely filled. Inside the filling frame 15, therefore, there is still a certain excess of molding sand which is required for a final compaction or consolidation by means of the press apparatus 19 (FIG. 1). In the final compaction the pattern plate carrier with the molding box and the filling frame is pressed farther upwardly, the pressure plate 18 being pressed correspondingly more deeply into the filling frame 15 until finally the desired degree of compaction is achieved.

We claim:

1. A foundry molding machine of the shot-type for producing box molds and comprising:

a molding box having two open ends;

injection apparatus having compressed air means and a filling vessel means for shooting the molding box with molding sand and precompacting the sand;

a pressure plate carried by the filling vessel means of the injection apparatus;

a pattern plate carrier means for closing one open end of the molding box during filling and compaction;

a filling frame means for resting against the other open end of the molding box during filling and compaction;

a closed annular passage means, defined within the filling frame means by internal walls of said filling frame means, for allowing the escape of spent air and for accumulating escaped sand;

press apparatus means, which is disposed underneath the pattern plate carrier means, for acting through the pattern plate carrier means and against the pressure plate to consolidate the sand; and venting aperture means, located on an inner wall of the filling frame, for allowing the escape of spent air from the molding box into the annular passage means;

whereby spent air can escape from the molding box through the venting aperture means and the annular passage means with only short-lived and less noise nuisance.

2. A foundry molding machine according to claim 1, wherein the pattern plate carrier means has venting slits on its surface.

3. A foundry molding machine according to claim 1, wherein the pressure plate has venting aperture means in its marginal zone for escape of spent air from the molding box directly to the outside atmosphere.

4. A foundry molding machine according to claim 1, wherein the annular passage means is connected to an exhaust air duct.

5. A foundry molding machine according to claim 1, wherein the venting aperture means in the filling frame means are connected to a vacuum pump.

6. A foundry molding machine according to claim 1, wherein the pressure plate is formed to define nozzles through which the molding sand passes when it is being injected into the molding box.

7. A foundry molding machine according to claim 6, wherein the nozzles in the pressure plate taper conically in the direction of the molding box.

* * * * *